US006435391B1

(12) United States Patent
Vazquez

(10) Patent No.: US 6,435,391 B1
(45) Date of Patent: Aug. 20, 2002

(54) DOUBLE LOOPED ENCLOSURE MECHANISM

(75) Inventor: Maximino Vazquez, New York, NY (US)

(73) Assignee: Maxworld, Inc., New York, NY (US)

( * ) Notice: Subject to any disclaimer, the term of this patent is extended or adjusted under 35 U.S.C. 154(b) by 0 days.

(21) Appl. No.: 09/710,406

(22) Filed: Nov. 9, 2000

Related U.S. Application Data

(63) Continuation-in-part of application No. 29/104,041, filed on Apr. 27, 1999, now Pat. No. Des. 439,040, which is a continuation-in-part of application No. 29/094,411, filed on Oct. 1, 1998, now Pat. No. Des. 411,764.

(51) Int. Cl.[7] ..... A45F 3/04; B65D 33/28

(52) U.S. Cl. ..... 224/656; 224/613; 383/72; 383/75

(58) Field of Search ..... 224/153, 613, 224/614, 61, 656; 383/72–77; D3/244

(56) References Cited

U.S. PATENT DOCUMENTS

| | | | | | |
|---|---|---|---|---|---|
| 2,510,186 | A | * | 6/1950 | Marsico et al. | |
| 2,563,616 | A | * | 8/1951 | Perino | |
| 2,710,639 | A | | 6/1955 | Farls | 150/7 |
| 4,011,898 | A | | 3/1977 | Hubbard | 150/35 |
| 4,148,347 | A | | 4/1979 | Seaman | 150/1.7 |
| 4,153,146 | A | | 5/1979 | Patton et al. | 190/44 |
| 4,301,849 | A | | 11/1981 | Litwack et al. | 150/33 |
| 4,334,601 | A | | 6/1982 | Davis | 190/44 |
| 4,515,300 | A | | 5/1985 | Cohen | 224/151 |
| D280,043 | S | | 8/1985 | Allen | D3/42 |
| D280,044 | S | | 8/1985 | Allen | D3/48 |
| D282,602 | S | | 2/1986 | Allen | D3/71 |
| D284,425 | S | | 7/1986 | Allen | D3/71 |
| 4,674,664 | A | | 6/1987 | Simon | |
| 5,030,014 | A | | 7/1991 | Diamond et al. | 383/127 |
| 5,127,536 | A | | 7/1992 | Cohen et al. | 224/222 |
| 5,187,823 | A | * | 2/1993 | Ferguson et al. | |
| 5,238,305 | A | * | 8/1993 | Feller | |
| D350,024 | S | | 8/1994 | Ryker | D3/229 |
| 5,490,619 | A | | 2/1996 | Boyar | 224/153 |
| D369,467 | S | | 5/1996 | Cole | D3/300 |
| 5,526,907 | A | | 6/1996 | Trawick et al. | 190/111 |
| 5,544,792 | A | | 8/1996 | Arnwine | 224/153 |
| D385,452 | S | | 10/1997 | Marti | D6/601 |
| 5,692,660 | A | | 12/1997 | Stewart | 224/581 |
| D389,642 | S | | 1/1998 | Nadel | D3/254 |
| D411,764 | S | * | 7/1999 | Vazquez | |
| D439,040 | S | * | 3/2001 | Vazquez | |

* cited by examiner

*Primary Examiner*—Gregory M. Vidovich
(74) *Attorney, Agent, or Firm*—Darby & Darby

(57) ABSTRACT

A combined adjustable closure and carry mechanism for a bag comprising a bag including a flexible channel in surrounding relationship to an aperture through which any bag contents can be accessed, a slider, and a single webbing having first and second ends wherein the first end being affixed to the bag and the second end being affixed to the slider. The webbing having portions intermediate the first and second ends which pass through the slider and through the flexible channel and the slider being slidably positionable along the webbing.

5 Claims, 7 Drawing Sheets

DOUBLE LOOPED ENCLOSURE MECHANISM

This patent application is a continuation-in-part of U.S. application Ser. No. 29/104,041, filed Apr. 27, 1999 for a CONVERTIBLE ZIPPER WALLET, which has matured in Des. U.S. Pat. No. 439,040, which is a continuation-in-part of U.S. Pat. No. Des. 411,764, issued Jul. 6, 1999, filed Oct. 1, 1998, for a CONVERTIBLE CLUTCH BAG.

FIELD OF THE INVENTION

The present invention relates to carry bags, and, more particularly, to a combined closure and carry mechanism for a cinching bag.

BACKGROUND OF THE INVENTION

In the art of knapsacks, backpacks and cinching bags, a variety of strap designs and closure mechanisms have been used. Many such bags employ discrete mechanisms for the closure and the carry strap. The closure may comprise a zipper, button, magnetic catch, corded cinch, or other mechanism. The carry strap may include one or two shoulder straps affixed to the upper and lower margins of the bag.

In bags that use cinching mechanisms to close an aperture, one or two loops are threaded through a flexible channel that surrounds the aperture. An exposed portion of the loop or loops is pulled to draw the flexible channel inwardly and close the aperture. FIG. 1 illustrates one known double-looped cinching bag 100 in which two loops 110, 120 are drawn in opposite directions to cinch closed the neck 130 of the bag. One end of the webbing that defines the loop is stitched to the webbing at 140 to define a certain size for each loop. The other end of the webbing extends downwardly to define carry strap portions 150, 160 which pass through a ring 170 and are each anchored to sliders 180 which are positionable along the respective carry strap portions. The sliders permit the length of the carry strap portions 150, 160 to be independently adjusted to suit the needs of its user. In FIG. 1, the sliders 180 are positioned proximate the stitching 140 so that the carry strap portions 150, 160 have their shortest effective length. In FIG. 2, the sliders have been repositioned along the webbing to provide the longest effective length carry strap portions 150, 160.

In this and other conventional arrangements in which the cinching and carry-strap functions are provided through a common webbing or corded arrangement, the cinch loops are fixed in size and sized to seat generally completely within the channel when the bag is open or uncinched. The problem with such a design is that the carry straps become quite long and unsightly when the bag is cinched (see FIG. 2). Further, at least two pieces of hardware are required for each strap to be adjusted in this manner.

What is needed in the art and heretofore has not been known is a combined closure and carry mechanism in which the cinching loop varies in size in response to adjustments in the carry strap. What is further needed is such a combined closure and carry mechanism which requires a minimum of hardware to provide both strap-length adjustment and a closure mechanism. The present invention satisfies these and other needs.

SUMMARY OF THE INVENTION

The invention provides a dual-action mechanism for combined carry-strap and bag-closure adjustments. The arrangement of elements in the combined combined closure and carry mechanism minimizes the hardware and webbings or cords needed to achieve these functions.

In one aspect, the invention concerns a combined adjustable closure and carry mechanism for a bag of the type having a flexible channel around an aperture. The mechanism includes a slider and a single piece of webbing having first and second ends. The first end of the webbing is affixed to the bag while the second end is affixed to the slider. The webbing has portions intermediate the first and second ends which pass through the slider and which also pass through the flexible channel. The slider is slidably positionable along the webbing to affect both closure of the bag and adjustment of the length of the carry straps.

In another aspect, the invention concerns a combined adjustable closure and carry mechanism for a bag having a double-loop closure mechanism for cinching the bag. Such a bag includes a flexible channel surrounding an aperture, and two draw cords or webs for closing the same. This mechanism comprises first and second sliders and first and second webbings. The first webbing has a first end affixed to the bag and a second end affixed to the first slider. The first webbing also has portions intermediate the first and second ends which pass through the first slider and through the flexible channel. The second webbing has a first end affixed to the bag and a second end affixed to the second slider. The second webbing similarly has portions intermediate the first and second ends which pass through the second slider and through the flexible channel.

These and other aspects of the invention can be appreciated from the following Brief Description of the Drawings and Detailed Description of a Preferred Embodiment.

DETAILED DESCRIPTION OF A PREFERRED EMBODIMENT

By way of overview and introduction, it is generally desirable to have an adjustable shoulder or carry strap mechanism to accommodate the needs of various users, for example, to better fit the bag to the shoulder and back of the user. Conventionally, providing an adjustable strap length has required hardware in addition to that used to close the bag. However, the present invention provides an elegant solution to conventional closure and carry strap mechanisms by accommodating a shortening of the carry strap as an increase in the cinch-loop size and vice versa.

Figure 1:
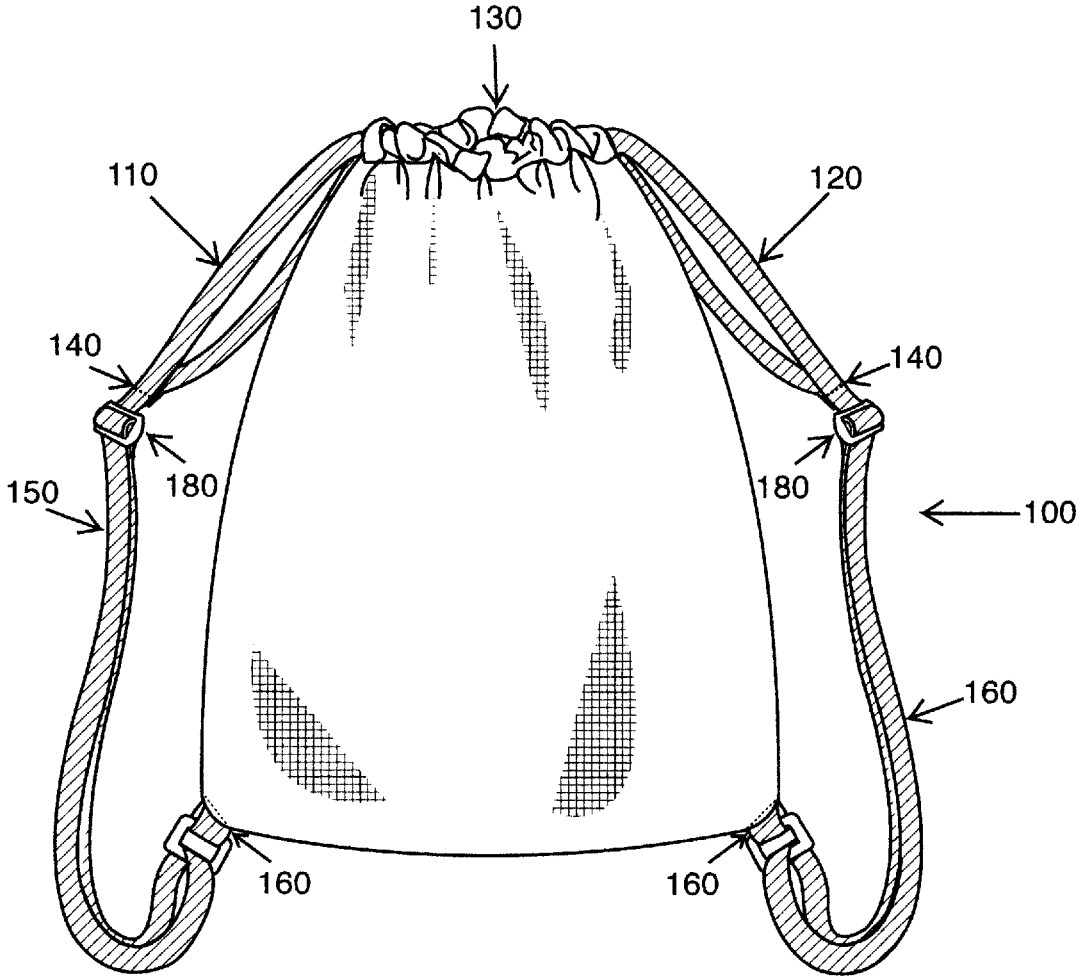
FIG. 1 illustrates a prior art combined closure and carry mechanism for a bag with the carry straps in a shortened condition.
Figure 2:
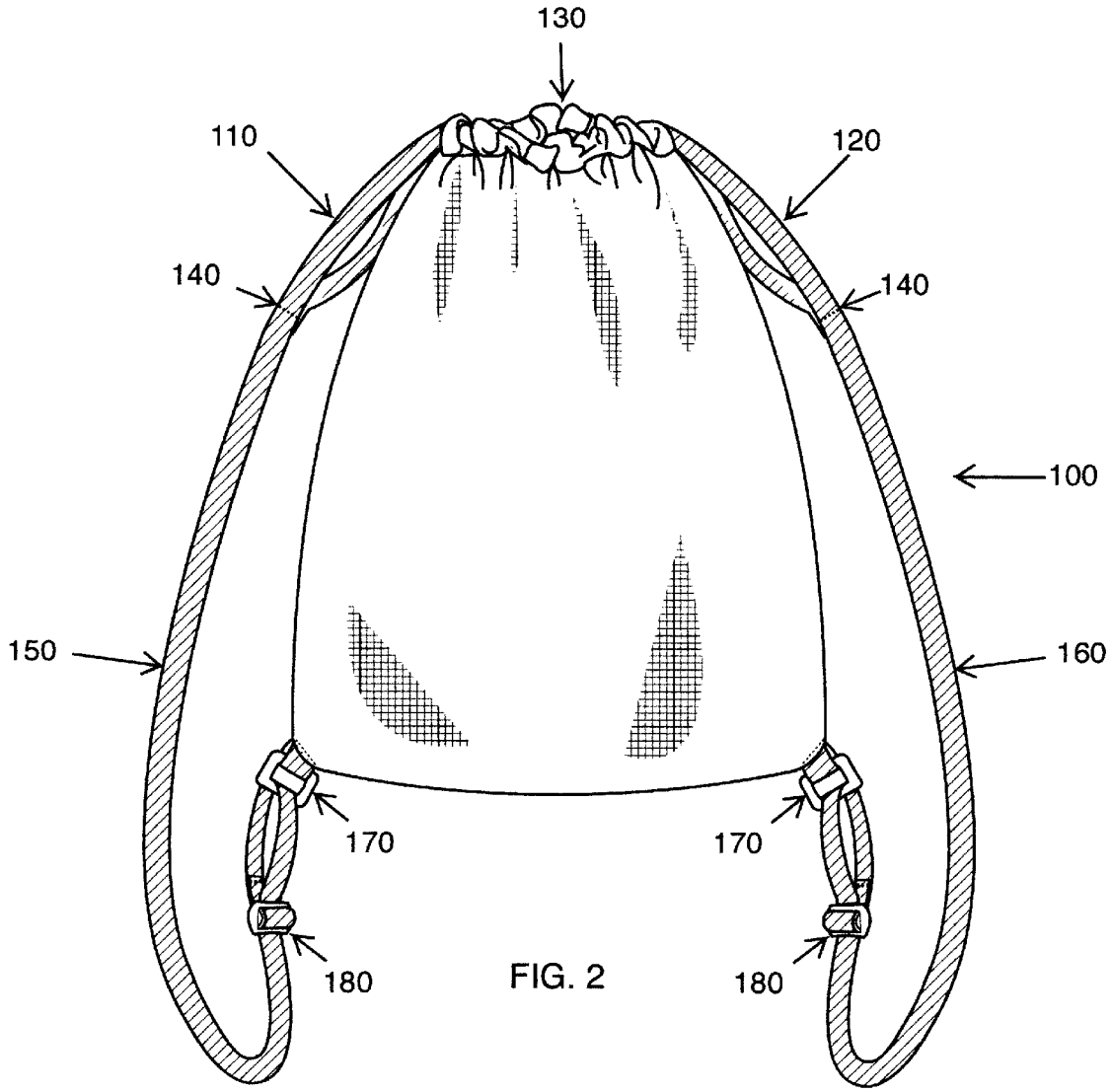
FIG. 2 illustrates the combined closure and carry mechanism of FIG. 1 with the carry straps in a lengthened condition.
Figure 3:
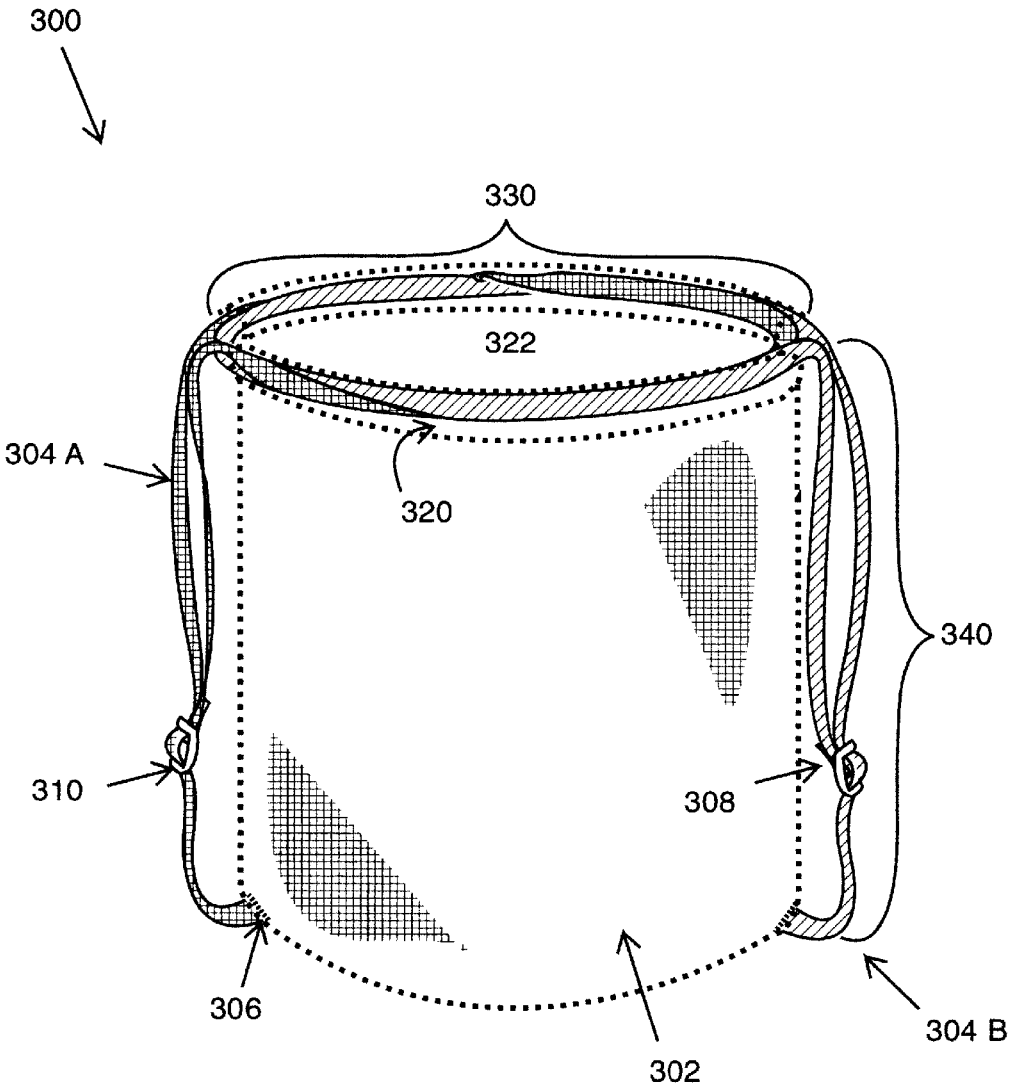
FIG. 3 illustrates a combined closure and carry mechanism in accordance with a preferred embodiment of the invention, shown with the carry straps in a shortened condition.
Figure 4:
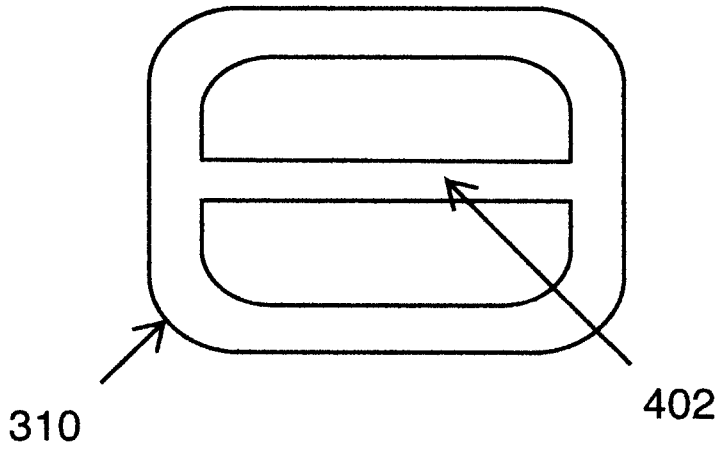
FIG. 4 is a top view of a double-D ring that may be used as a slider for adjusting the length of the carry straps.

With reference now to FIG. 3, a combined carry strap and closure mechanism 300 in accordance with a preferred embodiment is described. The carry strap and closure mechanism 300 can be used with a variety of bag designs; the details of the bag itself are not material to the present invention. The illustrated bag 302 is a backpack or knapsack of general construction, and has first and second identical webbings 304A, 304B (more generally referred to herein as webbings 304). Each webbing 304 has a first end 306 affixed to the bag 302 as by stitching, and a second end 308 affixed to a slider 310. The slider 310 is preferably a double-D shaped ring having a central bar 402 to which the second end 308 of the webbing is attached.

In accordance with a salient aspect of the present invention, a first or cinching portion 330 of the webbings 304 are passed through a channel 320 and arranged in variable-length loops which can be drawn to cinch an aperture 322 in the bag 302 and thereby close the aperture while a second or carry-strap portion 340 of the webbings having a length which varies with the length of the first portion remains external of the channel and arranged to permit the bag to be carried on one's shoulders, for example. The cinching portions 330 of the webbings 304A, 304B are preferably interlaced within the channel 320 to frictionally resist inadvertent opening of the bag 302. The aperture 322 provides access to whatever items are contained in the bag 302. The carry strap portion of the webbings 304 is passed through the slider 310 to permit adjustment of the strap length, as described below.

The channel 320 may be formed in a variety of ways which are not material to the present invention. The channel 320 of the bag 302 has first and second lumens, each of which can be accessed from an open, opposing end. The looped cinching portion 330 of the webbing 304A enters the first lumen at a near end, emerges from its opposing, far end, enters the second lumen at the far end, and extends through the second lumen to the near end. The looped cinching portion of the webbing 304B traverses through the lumens in the opposite direction: it enters the first lumen at the far end, emerges from its near end, enters the second lumen at the near end, and extends through the second lumen to the far end. Within the channel 320, the cinching portions 330 of the webbings 304A, 304B are interlaced with one another.

Figure 5:
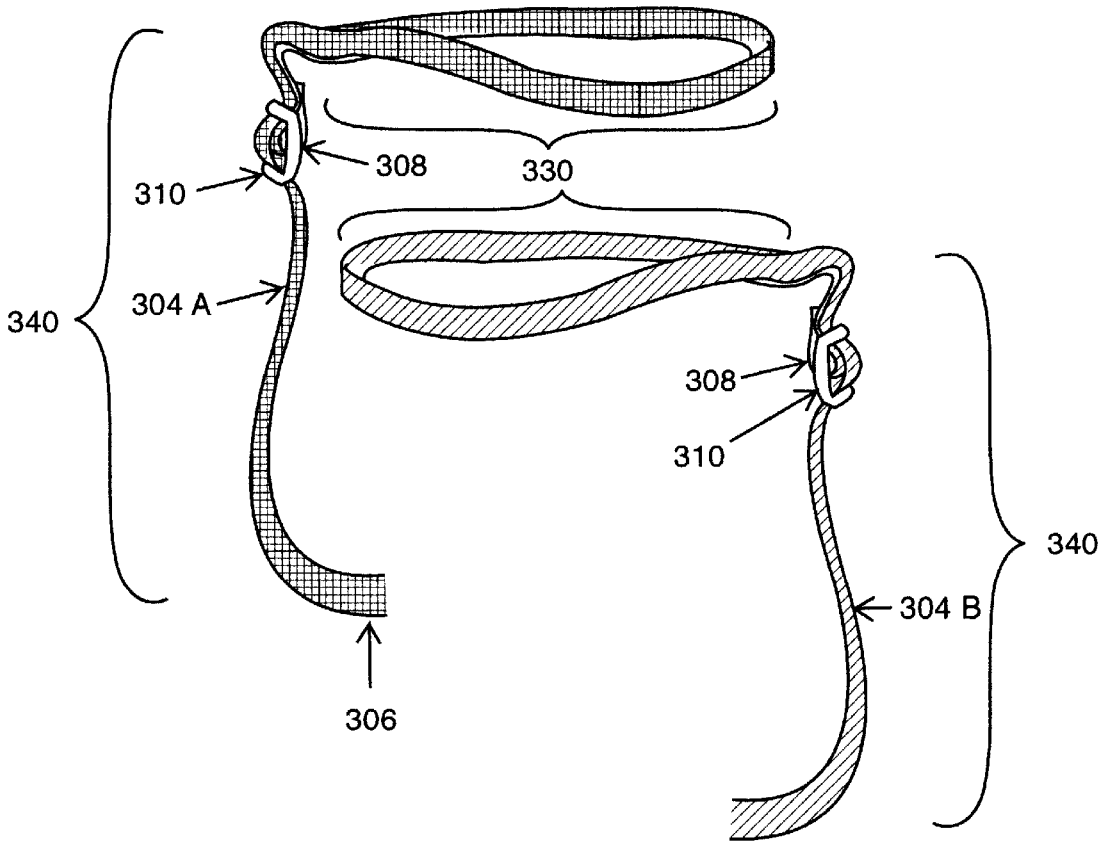
FIG. 5 is an exploded view of the closure and carry mechanism of FIG. 3.

FIG. 5 shows an exploded view of the first and second webbings 304A, 304B. As compared to FIG. 3, the sliders 310 are shown positioned further from the first end 306 of the webbing 304. The slider is slidably positionable along the webbing 304 to vary the length of the carry strap portion 340.

Figure 6:
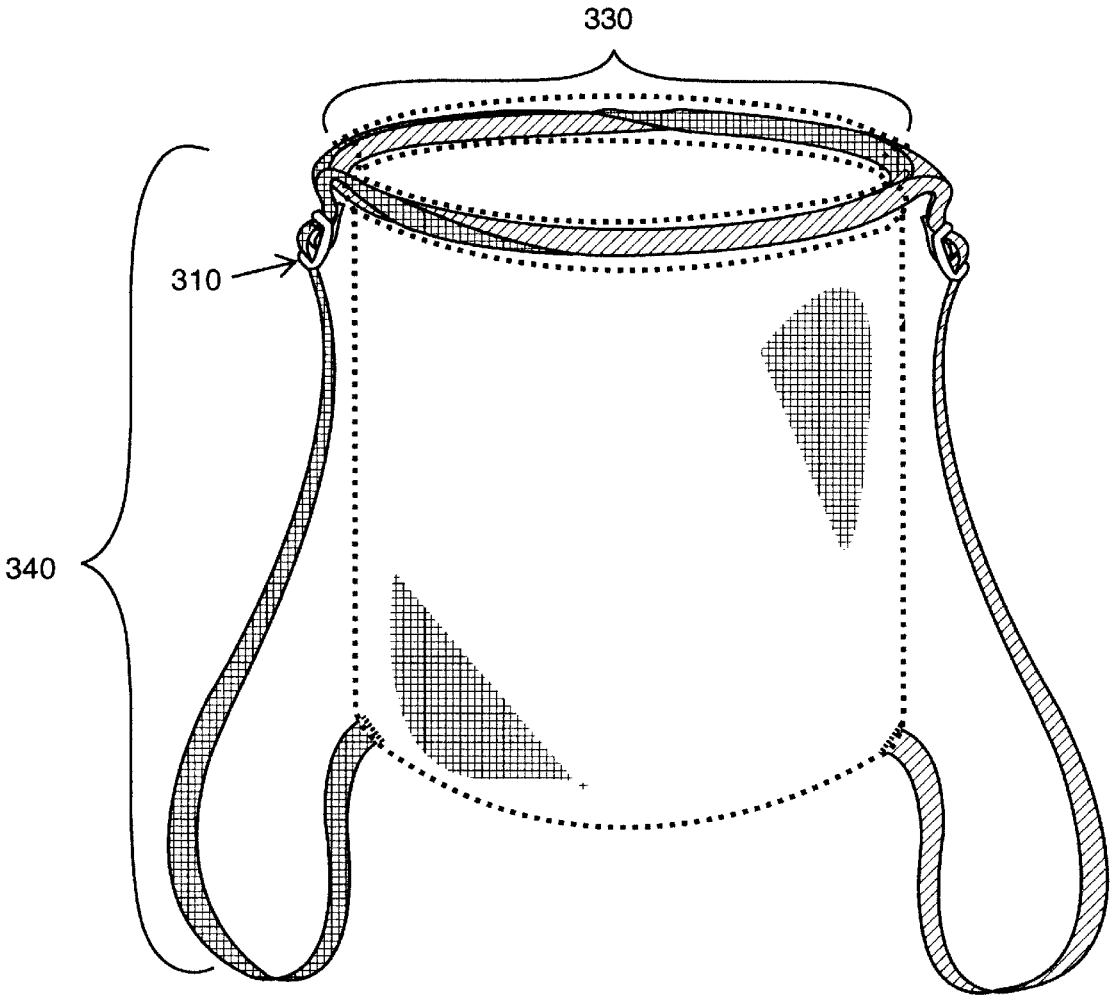
FIG. 6 illustrates the combined closure and carry mechanism of FIG. 3 with the carry straps in a lengthened condition.
Figure 7:
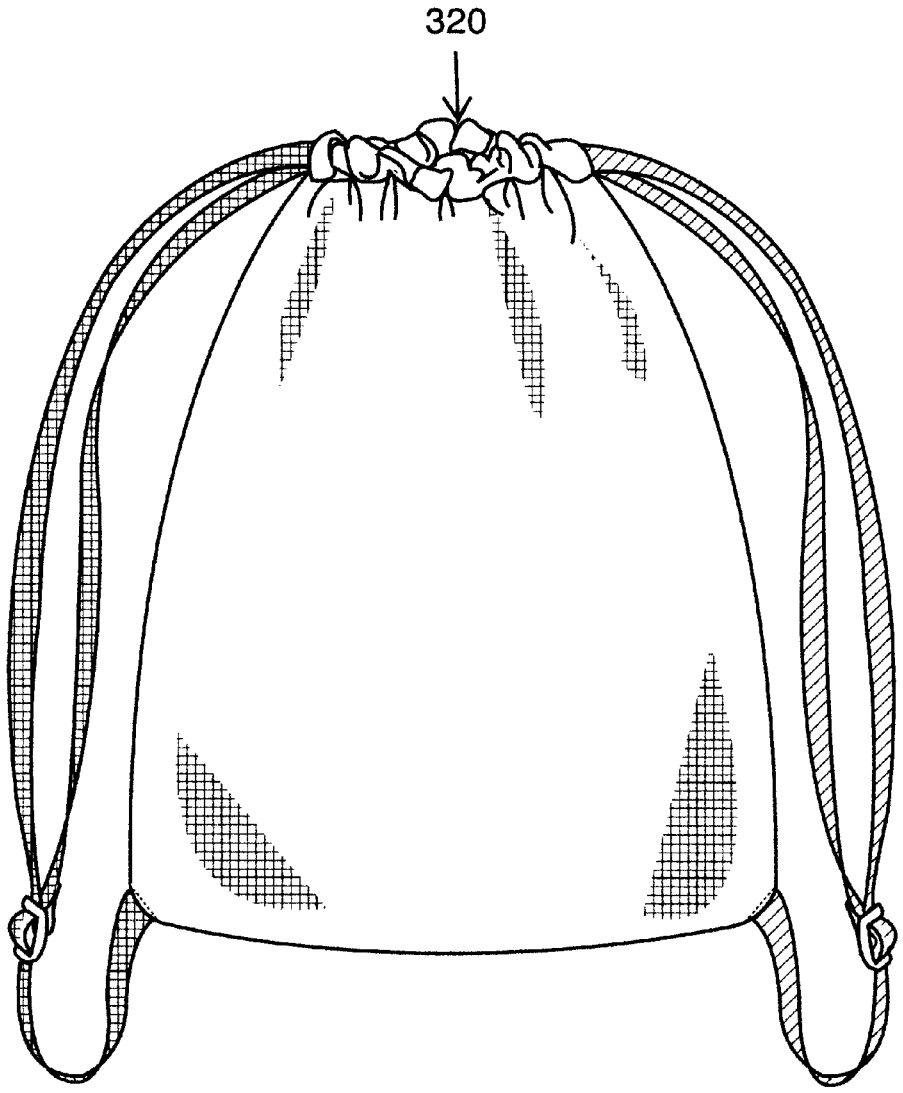
FIG. 7 illustrates a carry bag with the combined closure and carry mechanism of FIG. 3, shown with the carry scraps in a shortened condition and with the bag cinched closed.

As perhaps best appreciated by comparing FIGS. 3 and 6, the slider 310 is slidably mounted on the webbing and moves there along intermediate the first and second ends 306, 308 to adjust the effective length of the carry strap portion 340. Thus, the carry strap portion 340 is shortened (FIG. 3) by positioning the slider proximate the first end 306 of the webbing, and is lengthened (FIG. 6) by positioning the slider away from the first end 306 of the webbing. A comparison of these figures also illustrates a change in the size of the cinching loop portion 330. In particular, the size of the cinching loop is inversely related to the length of the carry strap portion 340. Such a construction is made feasible by selecting a length of webbing material for the webbing 304 which is sufficiently long to be carried on the torso of a large individual while the channel 320 of the bag is in a cinched state, as shown in FIG. 7).

Importantly, this arrangement permits dual adjustment of both carry strap length and the open/closed state of the bag using one hardware element (the slider 310) for each strap or webbing, and only one piece of webbing for each such strap. This reduction in both hardware and webbing permits a bag having such an arrangement to be more compactable into a smaller bag, if desired.

While the invention has been described in connection with a preferred embodiment in which two webbings 304 are used, other arrangements of the combined carry strap and closure mechanism which have only one webbing 304 are within the scope of the present invention which is defined by the claims appended hereto and substantial equivalents thereof, and which is not limited to the details of the foregoind description of the preferred embodiment.

I claim:

1. A combined adjustable closure and carry mechanism for a bag, comprising:

a. a bag, the bag including a flexible channel in surrounding relationship to an aperture through which any bag contents can be accessed;

b. a slider;

C. a single webbing having first and second ends, the first end being affixed to the bag and the second end being affixed to the slider, the webbing having portions intermediate the first and second ends which pass through the slider and through the flexible channel and the slider being slidably positionable along the webbing.

2. The mechanism as in claim 1, wherein the slider is a double-D ring.

3. A combined adjustable closure and carry mechanism for a bag, comprising:

a. a bag, the bag including a flexible channel in surrounding relationship to an aperture through which any bag contents can be accessed;

b. first and second sliders; and c. first and second webbings, said first webbing having a first end affixed to the bag and a second end affixed to said first slider, said first webbing having portions intermediate the first and second ends which pass through said first slider and through the flexible channel, said second webbing having a first end affixed to the bag and a second end affixed to said secondslider, said second webbing having portions intermediate the first and second ends which pass through said second slider and through the flexible channel.

4. The mechanism as in claim 3, wherein the first slider is slidably positionable along the first webbing.

5. The mechanism as in claim 3, wherein the portion of the first and second webbings that passes through the flexible channel are interlaced with one another.

* * * * *